United States Patent [19]

Kuhn

[11] Patent Number: 4,968,861

[45] Date of Patent: Nov. 6, 1990

[54] ACTUATOR MECHANISM FOR A HIGH-VOLTAGE CIRCUIT BREAKER

[75] Inventor: Max Kuhn, Unterentfelden, Switzerland

[73] Assignee: Sprecher Energie AG, Oberentfelden, Switzerland

[21] Appl. No.: 283,869

[22] Filed: Dec. 13, 1988

[30] Foreign Application Priority Data

Dec. 14, 1987 [CH] Switzerland ..... 04861/87

[51] Int. Cl.[5] ..... H01H 5/00

[52] U.S. Cl. ..... 200/400; 200/81 R; 200/501

[58] Field of Search ..... 200/400, 501, 502, 81 R, 200/82 B, 82 C; 185/40 R, 40 B; 60/413, 418, 494

[56] References Cited

U.S. PATENT DOCUMENTS

| | | | |
|---|---|---|---|
| 2,822,445 | 2/1958 | Schindler et al. | 335/76 |
| 3,867,814 | 2/1975 | Schneider | 185/40 R |
| 4,166,937 | 9/1979 | Imam et al. | 200/82 B |

FOREIGN PATENT DOCUMENTS

| | | |
|---|---|---|
| 745277 | 3/1944 | Fed. Rep. of Germany . |
| 3447132 | 7/1986 | Fed. Rep. of Germany . |
| 3540674 | 5/1987 | Fed. Rep. of Germany . |
| 1377843 | 12/1964 | France . |
| 323443 | 9/1957 | Switzerland . |
| 379865 | 9/1964 | Switzerland . |

OTHER PUBLICATIONS

"Super-Baby", Sprecher Energie Revue, No. 1/86, pp. 4 and 5.

*Primary Examiner*—Henry J. Recla
*Assistant Examiner*—Keith Kupferschmid
*Attorney, Agent, or Firm*—Fleit, Jacobson, Cohn, Price, Holman & Stern

[57] ABSTRACT

In a stored-spring-energy type actuator mechanism for a high-voltage circuit breaker, energy is stored in a spiral spring in order to switch on the circuit breaker and also to load a switch-off spring of the circuit breaker. To store sufficient energy for more than one switch-on operation, a fluid-pressure accumulator is provided in which sufficient energy is stored to wind up the spiral ring at least one additional time through a fluid-pressure motor. Between the pressure accumulator and the motor is a control valve which opens when the spiral spring is partly unloaded, causing the hydraulic motor to rewind the spring.

13 Claims, 1 Drawing Sheet

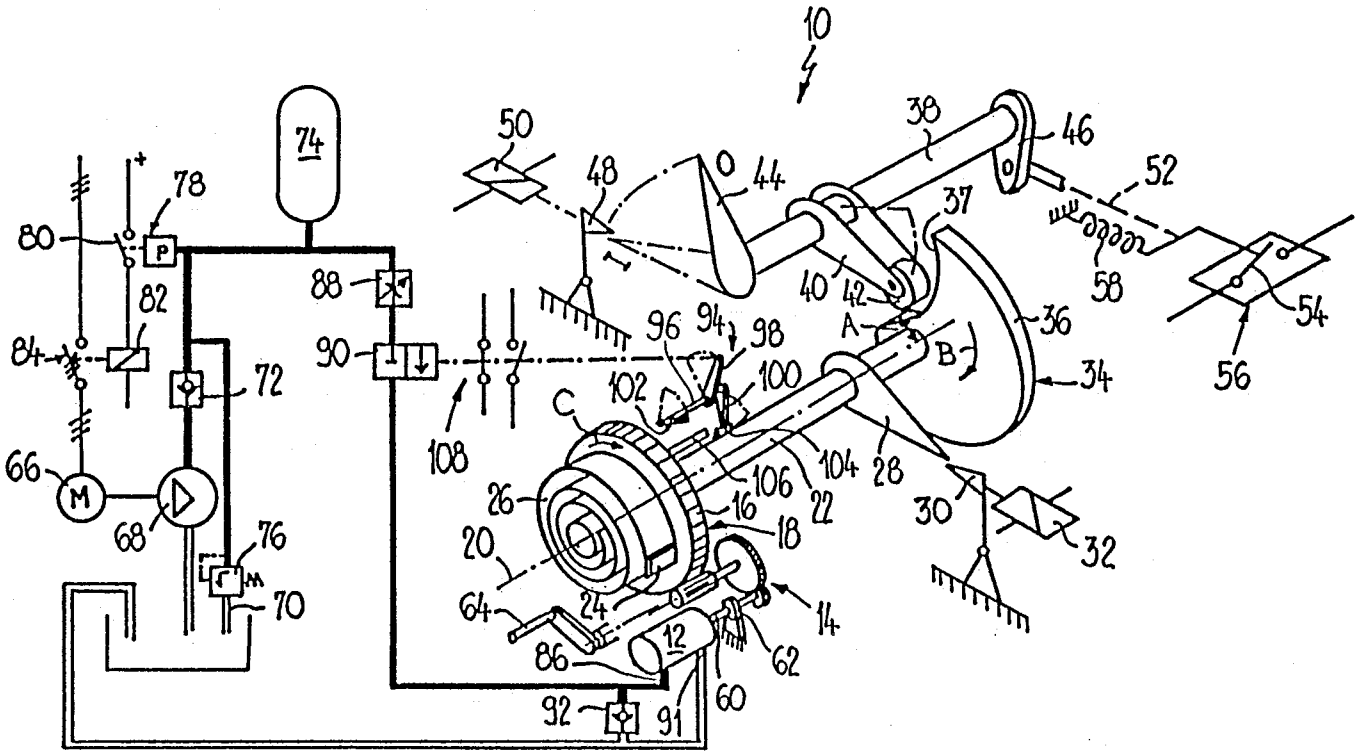
10
12
14
16
18
20
22
24
26
28
30
32
34
36
37
38
40
42
44
46
48
50
52
54
56
58
60
62
64
66
68
70
72
74
76
78
80
82
84
86
88
90
91
92
94
96
98
100
102
104
106
108
A
B
C
I
O

ACTUATOR MECHANISM FOR A HIGH-VOLTAGE CIRCUIT BREAKER

FIELD OF THE INVENTION

This invention relates to a stored-spring energy type actuator mechanism for a high-voltage circuit breaker.

BACKGROUND OF THE INVENTION

A stored-spring-energy type actuator mechanism of the above kind is described, for example, in "Sprecher Energie Revue" No. 1/86 on pages 4 and 5. In this arrangement energy for switching on a high-voltage circuit breaker and for simultaneously loading a circuit-breaker switch-off spring is stored in a spring-energy accumulator. The spring-energy accumulator can be loaded by means of an electric motor or by hand. When the high-voltage circuit breaker is switched on and the spring-energy accumulator and the switch-off spring accumulator are loaded, the circuit breaker can subsequently be switched off, switched on and switched off again without the spring-energy accumulator having to be recharged. For reasons of reliability of supply, it is desirable that the circuit breaker be able to execute a plurality of such switching actions even in the event of failure of the feed network of the actuator mechanism. In order to provide such operation, it has been proposed, for example, in German Offenlegungsschrift No. 3,540,674, to make the stored energy of the spring-energy accumulator sufficiently high that the high-voltage circuit breaker can be switched on several times and the switch-off spring accumulator charged at the same time. As a result of the spring characteristics, however, if the spring-energy accumulator is not re-charged, there is substantially more energy available for the first switching action than for subsequent switching actions.

This requires on the one hand additional damping elements for dissipating excess energy and on the other hand appropriate dimensioning of the actuator mechanism for substantial stored energies and the high forces consequently occurring.

SUMMARY OF THE INVENTION

It is an object of the invention to provide a stored-spring-energy actuator mechanism with a spring-energy accumulator in which energy for switching on a high-voltage circuit breaker can be stored to an extent sufficient for the mechanism to switch on the circuit breaker at least one time in the event of failure of the feed network.

In fulfillment of the above object, at least in a preferred form of the invention, the stored energy for a single switch-on operation of a high-voltage circuit breaker is stored in a spring-energy accumulator. The energy for further switching operations may be stored in a fluid-pressure accumulator, which feeds a fluid motor via a control valve and by means of which motor the spring-energy accumulator can be charged. In the known stored-spring-energy drive, the electric motor can thus be replaced by a fluid motor which can be fed from a local fluid-pressure accumulator. This can be done without substantial modification to the known form of stored-spring-energy mechanism.

In a preferred embodiment of the invention, there is connected in parallel with the fluid motor a check valve which is conductive to flow in a direction from a low-pressure connection to a high-pressure connection of the fluid motor and restrictive to flow in the opposite direction. The spring-energy accumulator can thus be wound up by hand, for example by means of a crank, without having to intervene in either the fluid circuit or the mechanical connections between the fluid motor and the spring-energy accumulator.

In a further preferred embodiment, a control means is provided for opening the valve when the spring-energy accumulator is partly unloaded. This ensures immediate recharging of the spring-energy accumulator even during or after a switch-on operation so that switch-on actions of the high voltage circuit breaker can be preformed in brief succession.

The fluid motor can be driven by means of hydraulic fluid which can be pumped by means of a pump through a check valve from a low-pressure source into the fluid-pressure accumulator. This enables high-voltage circuit breakers which are already installed, for example in a switch gear plant, to be re-equipped without having substantially to change the infrastructure. The original electrical feeder line provided for the electric motor for charging the spring-energy accumulator can be connected to the pump, which only involves adjustments to the stored-spring-energy actuator. A stored-spring-energy actuator with a fluid motor which can be driven by means of a gas, in particular compressed air, pumped into the fluid-pressure accumulator by means of a local compressor, has the same advantages. If a central supply of pressurized gas is installed in the switchgear plant, the fluid-pressure accumulator can be connected directly to such supply.

In a multiple-pole high-voltage circuit breaker having a stored-spring-energy actuator mechanism for each pole, a single local fluid-pressure accumulator can be provided for all of the actuator mechanisms. Without great expense, feed lines can be led from the fluid-pressure accumulator to the loading devices of each mechanism.

BRIEF DESCRIPTION OF DRAWING

An exemplary embodiment of the invention is described in greater detail with reference to the single drawing FIGURE. The drawing is a diagrammatic view of a stored-spring-energy actuator mechanism having a loading device for charging a spring-energy accumulator, which loading device has a fluid motor which can be fed from a local fluid-pressure accumulator.

DESCRIPTION OF PREFERRED EMBODIMENT

A stored-spring-energy actuator mechanism 10 has hydraulic motor 12 which acts via gearing 14 on a toothed rim 16 of a rotatably mounted spring cage 18. The rotational axis 20 of the spring cage 18 coincides with the axis of a spring shaft 22. Fixed to a laterally protruding lug 24 on the spring cage 18 is the outer end of a spiral spring 26 having an inner end connected to the spring shaft 22.

Connected for rotation with the spring shaft 22 is a switch-on latch lever 28 supported in releasable manner on a switch-on latch 30. By means of an electrically actuable switch-on magnet system 32, the switch-on latch 30 can be pivoted clockwise from the position shown in the FIGURE into a release position. A cam plate 34 is also mounted for rotation on the spring shaft 22. The distance, designated A, between the rotational axis 20 and a radial contact surface 36 of the cam plate 34 increases continuously, in a direction opposite the direction of arrow B, of the cam. A transition from the greatest distance A to the smallest distance A is effected by a slightly curved, virtually radially extending edge 37.

A bifurcated roller lever 40 is carried for rotation on a rotatably mounted roller-lever shaft 38 arranged in parallel to axis 20. Rotatably mounted at the free end of lever 40 is a roller 42 with which the contact surface 36 of the cam plate 34 can engage. The roller-lever shaft 38 carries a switch-off latch 44 at one end, and a transmission lever 46 at the other end. The switch-off latch lever 44 is shown in solid lines in a switch-off position O. It can be pivoted anti-clockwise into a switch-on position I shown by chain-dotted lines. In the switch-on position I, the switch-off latch lever 44 is supported in a releasable manner on a switch-off latch 48 which can be pivoted from the position shown into a release position by means of an electrically controllable switch-off magnet system 50. Likewise indicated by chain-dotted lines is the position of the roller lever 40 in the switch-on position I.

The transmission lever 46 is operatively connected through a diagrammatically indicated transmission system 52, to a movable switch contact 54 of a high-voltage circuit breaker 56 and to a switch-off spring 58.

The above-described elements of the stored-spring-energy drive mechanism 10 work as follows. When the switch-on latch lever 28 is supported on the switch-on latch 30, the spring cage 18 can be rotated through 360°, in arrow direction C by means of the hydraulic motor 12, to load spring 26. The energy thus stored in the spiral spring 26 is sufficiently large to switch on the high-voltage circuit breaker 56 and at the same time load the switch-off spring 58, as will now be described.

When the switch-on magnet system 32 is excited, the switch-on latch 30 is pulled back into the release position so that the spring shaft 22 together with the cam plate 34 is free to rotate in arrow direction B under the influence of loaded spring 26. The roller 42 thereby comes to bear on the contact surface 36, which results in the roller lever 40 and thus the roller-lever shaft 38 being pivoted anti-clockwise into the switch-on position I. Once the switch-on latch lever 28 is released, the switch-on latch 30 immediately returns again into its neutral position so that, after a revolution of 360°, the switch-on latch lever 28 again comes to bear on the switch-on latch 30.

As a result of the pivoting movement of the roller-lever shaft 38, the switch-off latch lever 44, in the switch-on position I, latches on the switch-off latch 48. Due to the fact that the transmission lever 46 also pivots, the high-voltage circuit breaker 56 is switched on and the switch-off spring 58 is loaded at the same time.

The spiral spring 26 can now be loaded again by rotation of the spring cage 18 by means of the hydraulic motor 12.

In order to switch off the high-voltage circuit breaker 56, the switch-off magnet system 50 is excited, whereupon the switch-off latch 48 releases the switch-off latch lever 44. The switch contact 54 of the high-voltage circuit breaker 56 is opened by the switch-off energy stored in the switch-off spring 58 and the roller-lever shaft 38 is rotated into the switch-off position O. During this movement, the edge 37, running approximately radially inwardly of the cam plate 34, provides sufficient clearance space to accommodate pivoting movement of the roller lever 40 and roller 42.

It may be noted that a single pole of a high-voltage circuit breaker 56 or a plurality of poles can be actuated by means of a single stored-spring-energy mechanism 10.

A backstop or clutch device 62 acts on the output shaft 60 of the hydraulic motor 12 in such a way that rotation of shaft 60 in a direction to load the spiral spring 26 is permitted but rotation in the reverse direction is prevented. Undesirable unloading of the spiral spring 26 is thereby prevented. The spiral spring 26 can alternatively be loaded by hand, by means of a crank 64 which can be brought into operative connection with gearing 14.

A hydraulic pump 68 driven by an electric motor 66 is provided for pumping hydraulic fluid, for example hydraulic oil, from a low-pressure reservoir 70 through a check valve 72 into a generally known hydraulic pressure accumulator 74. In this arrangement, the check valve 72 prevents hydraulic fluid under pressure from flowing back to the pump 60 and the reservoir 70. In order to prevent an excessive pressure increase in the pressure accumulator 74, the pressure accumulator 74 is hydraulically connected to a pressure-relief valve 76 which opens at excessive pressure and allows the hydraulic fluid to flow back into the low-pressure tank 70 until the pressure in the pressure accumulator 74 has dropped to the desired value. Also hydraulically connected to the pressure accumulator 74 is a pressure relay 78 with switch contacts 80 which close when the pressure in the accumulator 74 falls below a lower limit value and open at an upper limit value. The pressure relay 78 controls an excitation coil 82 of a switch 84 by means of which the electric motor 66 can be switched on and off.

An adjustable orifice 88 for regulating the fluid flow rate and also a controllable valve 90 are connected in series between the pressure accumulator 74 and a high-pressure connection 86 of the hydraulic motor 12. A low-pressure connection 91 of motor 12 is hydraulically connected to the reservoir 70. A further check valve 92 is connected in parallel with the hydraulic motor 12 in such a way that it is conductive in the direction from the low-pressure connection 91 to the high-pressure connection 86 of the hydraulic motor 12 and restrictive in the opposite direction.

The stored-spring-energy mechanism 10 is further provided with a control member 94 in operative connection with valve 90 as indicated in chain-dotted line. The control member 94 has a pivotable control shaft 96 parallel, to the rotational axis 20 and three single-arm levers 98, 100 and 102. In the position of the control member 94 shown in solid lines, the valve 90 is restrictive to fluid flow. In the position of member 94 indicated by chain-dotted lines (and pivoted anti-clockwise through about 45 degrees from the solid-line position,) the valve 90 is conductive to fluid flow. The lever 98 provides a connection which transfers the pivotal position of the control shaft 96 to the valve 90, while the lever 100, in the position shown by solid lines bears on a tongue 104 protruding radially outwardly from the spring shaft 22. The lever 102, in the position shown by chain-dotted lines, is pivoted into the path of a pin 106 arranged on the spring cage 18. As explained below, the control member 96 controls the valve 90 and also an auxiliary switch 108 as a function of the loaded state of the spiral spring 26.

The mode of operation and control of the hydraulic circuit is now described in greater detail. When the pressure in the pressure accumulator 74 drops below the lower limit value, the switch contacts 80 of the pressure relay 78 close, as a result of which the excitation coil 82 of the switch 84 is excited. The switch 84 switches on the electric motor 66, as a result of which hydraulic fluid is pumped from the reservoir 70 into the pressure accumulator 74. When the pressure in the pressure accumulator 74 reaches the upper limit value, the switch contacts 80 of the switch 78 open, as a result of which the electric motor 66 is switched off. The check valve 72 prevents hydraulic fluid from flowing back to the hydraulic pump 68 and into the reservoir 70. If for any reason the electric motor 66 does not stop, or for some other reason the pressure in the pressure accumulator 74 becomes too high, the pressure-relief valve 76 opens in order to protect the high-pressure system from damage. Under normal conditions, hydraulic fluid should always be stored in the pressure accumulator 74 at an adequate pressure.

When the spiral spring 26 is loaded, the control member 94 is located in the position shown by solid lines and valve 90 is restrictive to fluid flow. When the spring shaft 22 is released by the switch-on latch 30, the spring shaft 22 starts to rotate in arrow direction B, as a result of which the lever 100 and thus the entire control member 94 (as a result of the rotation of the tongue 104) are pivoted into the position shown by chain-dotted lines. The valve 90 is thus opened and the hydraulic motor 12 starts to rotate, as a result of which the spiral spring 26 is loaded in arrow direction C. Once the switch-on operation of the high-voltage circuit breaker 56 is completed, the spring shaft 22 has turned through 360° and is supported again on the switch-on latch 30. The rotation of the spring cage 18 by means of the hydraulic motor 12 takes place substantially slower than the unloading of the spiral spring 26 when the high-voltage circuit breaker 56 is switched on. When the spring cage 18 has been rotated through virtually 360° in arrow direction C, pin 106 engages lever 102 and pivots the lever back into the position shown in solid lines, as a result of which the valve 90 is closed and the hydraulic motor 12 stopped. The spiral spring 26 is now sufficiently loaded to be able to switch on the high-voltage circuit breaker 56 again. The force exerted on the spring cage 18 by the spiral spring 26 is absorbed by the backstop 62.

In normal working operation, the check valve 92 is closed and thus prevents hydraulic fluid from flowing from the line which feeds high-pressure connection 86 back to the reservoir 70. However, it may be necessary for the spiral spring 26, e.g., during inspection or assembly work, to be wound up by hand by means of the crank 64. During this operation, the hydraulic motor 12 changes to pump operation and pumps hydraulic fluid from the low-pressure connection 91 to the high pressure connection 86. In this event, check valve 92 opens and allows hydraulic fluid to circulate through the hydraulic motor 12 and the check valve 92.

The position of the auxiliary switch 108 gives an indication of the position of the control member 94 and thus also of the loaded condition of the spiral spring 26. The auxiliary switch is frequently required for feedback to a central switching station or for other monitoring purposes. It can readily be seen that an auxiliary switch 108 can also be used for the control of electrically actuable valve 90.

In high-voltage circuit breakers 56 in which each pole can be driven by means of a separate stored-spring-energy actuator 10, it may be advisable to use a single pressure accumulator 74 for winding up the spiral springs 26 of all poles.

Stored-spring-energy mechanisms 10 having an arrangement according to the invention for loading the spring-energy accumulators can also be used in high-voltage circuit breakers in which the spring-energy mechanism 10 only closes the switch contacts 54, and in which the switch contacts 54 can be opened by a separate actuator or by a switch-off spring 58 which is loaded by a separate actuator.

It is evident that the capacity of the fluid pressure accumulator 74 should be sufficient to provide at least one-time operation of the motor 12 to load spring 26 in a wind-up direction, in the event of an electrical power failure.

While only a preferred embodiment of the invention has been described herein in detail, the invention is not limited thereby and modifications can be made within the scope of the attached claims.

What is claimed is:

1. A stored-spring-energy type actuator mechanism for a high-voltage circuit breaker comprising the circuit breaker, a spring-energy accumulator, loading means for charging the spring-energy accumulator with energy, and transmission means for converting released energy of the accumulator into operation of the circuit breaker, wherein the loading means includes a fluid-pressure operated motor connected with the spring-energy accumulator, said fluid-pressure operated motor comprises a high pressure motor connection and a low-pressure motor connection, fluid supply means for the fluid-pressure operated motor including a fluid-pressure accumulator having an energy capacity corresponding to an energy requirement for charging the spring-energy accumulator at least one time and connected to the high-pressure motor connection, and a control valve means for controlling flow of fluid from the fluid-pressure accumulator to the motor, and control means operable by the spring-energy accumulator for opening the control valve when the spring-energy accumulator is partly loaded.

2. The mechanism as claimed in claim 1 which includes a flow regulator means between the fluid-pressure accumulator and the motor.

3. The mechanism as claimed in claim 1 which includes said fluid-pressure operated motor having a high-pressure motor connection connected to said fluid-pressure accumulator and a low-pressure motor connection, a check valve connected in parallel with the fluid motor between respective low-pressure and high-pressure motor connections, the check valve being conductive to fluid flow in a direction from the low-pressure connection to the high-pressure connection and being restrictive to fluid flow in the opposite direction, and a manually operated system associated with the fluid-pressure operated motor for charging the rating-energy accumulator manually.

4. The mechanism as claimed in claim 1 wherein the fluid motor has an output shaft provided with a clutch device for preventing rotation of the output shaft other than in a direction for storing energy in the spring-energy accumulator.

5. The mechanism as claimed in claim 4 wherein the output shaft is operatively connected to the spring-energy accumulator through gear means.

6. The mechanism as claimed in claim 1 which includes a pressure-relief valve hydraulically connected to the fluid-pressure accumulator.

7. The mechanism as claimed in claim 1 wherein the control means comprises a control member operatively connected to the control valve means for movement by the spring-energy accumulator into a valve opening position when the spring-energy accumulator is partly unloaded and into a valve-closing position when the spring-energy accumulator is fully loaded.

8. The mechanism as claimed in claim 1 wherein the control valve means comprises an electrically actuatable valve associated with an auxiliary switch, the auxiliary switch is switched on when the spring-energy accumulator is partly unloaded and switched off when the spring-energy accumulator is fully loaded.

9. The mechanism as claimed in claim 1 which includes a pump for delivering hydraulic fluid through a check valve from a low-pressure source into the fluid-pressure accumulator.

10. The mechanism as claimed in claim 9 including a pressure relay hydraulically connected to the fluid-pressure accumulator for controlling the pump.

11. The mechanism as claimed in claim 1 wherein the fluid motor is operable by pressurized gas which is delivered through a check valve into the fluid-pressure accumulator.

12. The mechanism as claimed in claim 1 wherein the spring-energy accumulator comprises a spiral spring with an inner end connected to a rotatable shaft, the transmission means including a cam plate mounted on said shaft, the lever having a follower means cooperating with the cam plate, the lever shaft being operatively connected to a switch-off spring device and to a movable switch contact of the high-voltage circuit breaker, the cam plate being configured for providing rotation of the lever shaft through the follower means from a switch-off position into a switch-on position.

13. The mechanism as claimed in claim 1 wherein the circuit breaker is a multiple pole circuit breaker, the spring-energy accumulator being replicated for each pole of the circuit breaker, and the fluid-pressure accumulator being a single fluid-pressure accumulator for all of the spring-energy accumulators.

* * * * *